United States Patent [19]

McArthur

[11] Patent Number: 4,711,450

[45] Date of Patent: Dec. 8, 1987

[54] MULTI-MODE EXERCISING APPARATUS

[76] Inventor: Jim McArthur, 51 Leeder Avenue, Coquitlam, British Columbia, Canada, V3K 3V5

[21] Appl. No.: 738,447

[22] Filed: May 28, 1985

Related U.S. Application Data

[63] Continuation of Ser. No. 427,121, Sep. 29, 1982.

[30] Foreign Application Priority Data

Jun. 1, 1982 [CA] Canada ..... 404235

[51] Int. Cl.[4] ..... A63B 23/04

[52] U.S. Cl. ..... 272/129; 272/130; 272/DIG. 5; 272/DIG. 6

[58] Field of Search ..... 272/129, 130, DIG. 5, 272/DIG. 6

[56] References Cited

U.S. PATENT DOCUMENTS

| | | | |
|---|---|---|---|
| 2,725,231 | 11/1955 | Hoover . | |
| 3,400,793 | 9/1968 | Norris et al. . | |
| 3,465,592 | 9/1969 | Perrine . | |
| 3,494,616 | 2/1970 | Parsons . | |
| 3,495,824 | 2/1970 | Cuinier . | |
| 3,784,194 | 1/1974 | Perrine . | |
| 3,848,467 | 11/1974 | Flavell . | |
| 3,858,873 | 1/1975 | Jones . | |
| 3,869,121 | 3/1975 | Flavell . | |
| 3,998,100 | 12/1976 | Pizatella et al. | 272/129 |
| 4,063,726 | 12/1977 | Wilson . | |
| 4,141,248 | 2/1979 | Bargenda . | |
| 4,144,568 | 3/1979 | Hiller et al. . | |
| 4,184,678 | 1/1980 | Flavell et al. . | |
| 4,226,415 | 10/1980 | Wright | 272/130 |
| 4,333,340 | 6/1982 | Elmeskog . | |
| 4,354,676 | 10/1982 | Ariel . | |
| 4,544,154 | 10/1985 | Ariel | 272/130 |

*Primary Examiner*—Leo P. Picard

*Attorney, Agent, or Firm*—Bell, Seltzer, Park & Gibson

[57] ABSTRACT

A computer controlled exercising apparatus is disclosed which includes a rotary actuator having an output shaft, and a hydraulic power system for powering the actuator in either rotational direction. The output shaft of the actuator includes splined opposite free ends, and a radial arm is selectively attachable to either one of the ends. The outer end of the radial arm mounts a user engageable handle, and a load cell is mounted immediately adjacent the handle, so as to provide an output signal which does not include any force component from the weight or inertia of the radial arm. The apparatus also includes means for sensing the rotational position of the actuator, and the signals from the load cell and the position sensing means are fed to a computerized controller, which in turn controls the operation of the actuator in accordance with a predetermined program.

12 Claims, 6 Drawing Figures

Fig. 1.
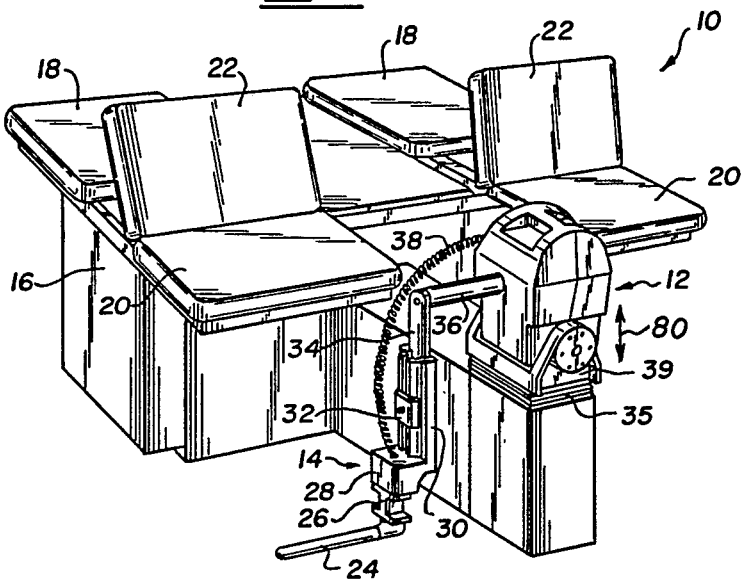
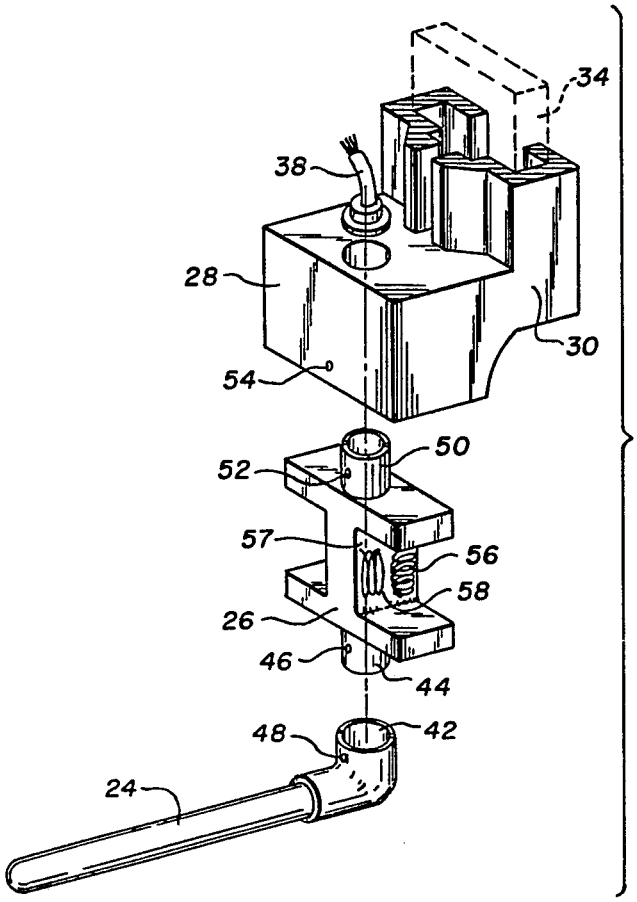
Fig. 2.

MULTI-MODE EXERCISING APPARATUS

The present application is a continuation application of U.S. patent application Ser. No. 427,121 filed Sept. 29, 1982.

BACKGROUND OF THE INVENTION

The present invention relates to a multi-mode exercising apparatus for providing exercise in isometric, isotonic, isokinetic and constant power modes.

In isometric exercises the rate of angular change or velocity of the limb is zero, while the force can be in either of two directions. In an isotonic mode the load or resistive force has a constant value while the velocity varies. In an isokinetic mode the force is allowed to vary to match the user's force in such a way that the velocity is kept constant. Finally, in a constant power mode both velocity and force are allowed to vary such that their product is kept constant. In any of the latter three modes a muscle may undergo either a concentric contraction in which the muscle is developing force while it is shortening in length, or an eccentric contraction in which the muscle is developing force while it is increasing in length. By way of example, in a concentric stroke the user moves the arm or limb of the exercising machine while in an eccentric stroke the arm attempts to move the limb of the user.

Exercise apparatus exists which provide a constant force load by means of weighted plates or springs over the whole range of movement of the limb. Since the muscle is generally strongest over a relatively narrow range of such movement, fixed load or constant force devices do not optimally load a muscle through its entire range of movement. A device which does load a muscle on an approximate constant velocity basis is disclosed in U.S. Pat. No. 3,465,592, issued to Perrine on Sept. 9, 1969. The Perrine device employs a hydraulic piston-cylinder in combination with a constant flow valve and an associated valving system to provide a constant flow through one side or the other of the hydraulic piston-cylinder. A pressure valve measuring fluid pressure is used to measure user applied force. Perrine also discloses an alternative embodiment employing an electric motor and a gearing system and clutches to couple user torque to a worm gear being rotated by a motor at a constant velocity. The latter device is restricted to either an isometric or an approximate constant velocity mode and to concentric exercises rather than both concentric and eccentric exercises. Moreover, the Perrine device includes in its measurement of the force the weight of the handle and arm linkage and resistance caused by friction.

U.S. Pat. No. 3,784,194 issued Jan. 8, 1974 to Perrine discloses the use of a fluid operated actuator in combination with a system of overlapping valve holes for setting the rate of fluid flow and consequent velocity. The latter device again is restricted to an approximate constant velocity mode and is subject to the other limitations expressed in connection with the above-mentioned earlier Perrine patent.

SUMMARY OF THE INVENTION

According to the invention there is provided a multi-mode exercising apparatus comprising an exercising member, a hydraulically controlled actuator coupled to the exercising member for controlling movement of the latter, a servo valve coupled to the actuator for controlling hydraulic fluid flow thereto in response to an input electrical signal and a hydraulic pump for pressurizing hydraulic fluid directed to said servo valve motor means for driving said pump. A fluid reservoir is coupled to the pump and means are used to monitor the angular position of the actuator. Microprocessor means are used for controlling operation of the apparatus which is characterized in that the actuator is a rotary actuator an output shaft of which is coupled to the exercising member without intermediate link arms movable relative to one another. A load cell means is coupled directly to the exercising member for detecting the magnitude of force applied to the latter at the point of application of force thereto and for providing a signal to the microprocessor proportional to the force. The angular position monitoring means detects the angular position of the exercising member as a function of time and provides signals to the microprocessor means proportional to position, velocity and acceleration and a selectable direction of rotation of the exercising member. The microprocessor means provides the input electrical signal to the servo valve, the magnitude of which is variable in response to program means conditioning the microprocessing means, input data and signals, including those from the load cell means and the angular position monitoring means. In response to the input electrical signal, the servo valve is operative to cause the rotary actuator to reversibly rotate through selectable angular amounts with selectable angular velocities, angular accelerations and direction of rotation and in response to selectable variations of either eccentric or concentric force as a function of angle, speed and acceleration. Location of the load cell means proximate the point of application of force to the exercising member results in a signal which is proportional to the actual magnitude of user applied force to the member, thereby avoiding inaccuracies involved in compensation for the weight of the exercising member when force readings are taken remote from the location of use applied force.

By utilizing a servo valve, a highly accurate control of fluid flow into the actuator is possible by simply controlling the level of input current to the servo valve. The utilization of a microprocessor permits a wide variety of modes of operation of the actuator together with the implementation of a large number of safety checks.

Preferably the angular position monitoring means is an optical shaft encoder for providing signals indicative of angular acceleration, velocity, position and direction of rotation of the rotary actuator. Since ther are no links or joints between the actuator shaft and the point of user applied force, location of the optical shaft encoder proximate the actuator shaft provides accurate position monitoring means. Utilization of an optical shaft encoder further provides signals which are compatible with a digital system.

Conveniently, a dump valve can be used for shunting fluid flow out of the hydraulic pump in the event interruption of the operation of the exercising member is desired. Dump valve switch means may be provided for controlling power supply to the dump valve.

Means for sensing actuator fluid pressure to provide signals whose differential is proportional to the external torque applied to the actuator by the member may also be provided as may means for sensing the application of power to the dump valve and means for sensing the application of power to the motor.

Manually operable override switch means for controlling power to the motor means may also be used.

The microprocessor means may be conditioned for controlling operation of the dump valve switch means, controlling power applied to the motor means and for providing the electrical signal of variable magnitude to the servo valve, although the foregoing being in response to program means, input data and calibration data stored in the microprocessor, actuator fluid pressure levels, signals from the optical shaft encoder, signals from the load cell means, motor sensing means, the dump valve sensing means and the condition of the override switch means.

The load cell means may be a deformation load cell having two conductors whose deformation results in a change of resistance of each from which the component of force applied in only the direction transverse to the member can be obtained.

The microprocessor means may be conditioned to compare the signals from the load cell means and from the actuator fluid pressure sensing means in order to detect abnormal applications of force to the exercising member.

The exercising member referred to above is capable of operating in response to instructions from the computer and input data in any one of four basic exercise modes through selectable angles of rotation and with selectable amounts of force. The apparatus may also be employed in either a concentric or an eccentric force condition. By sensing the motor and dump valve power levels, actuator pressure levels and load cell voltage levels, a sophisticated set of redundant safety checks may be constantly effected by the microprocessor means in addition to hardware control safety measures to provide a high level of safety and flexibility combined with significantly improved accuracy than hitherto known devices.

BRIEF DESCRIPTION OF THE DRAWINGS

In drawings representing a preferred embodiment of the invention,

FIG. 1 is a perspective view of the exercising apparatus without the microprocessor;

FIG. 2 is an exploded view of the handle attachment;

DETAILED DESCRIPTION WITH REFERENCE TO THE DRAWINGS

Figure 3:
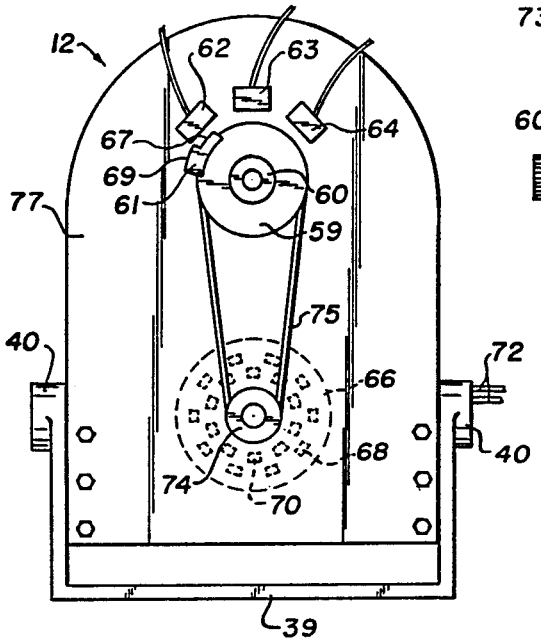
FIG. 3 is a front elevation view of the actuator assembly with the casing removed.

The user station 10 of the exercising apparatus shown in FIG. 1 consists of an actuator assembly 12 having an actuator shaft 60 (see FIG. 3) to which is attached an exercising member 14. A housing 16 enclosing a hydraulic pump and heat exchanger (not shown) also supports a set of cushions 18, 20 and 22 adjacent each side of the actuator assembly 12. The central cushion 22 of each set of cushions is positionable in selectable reclined positions from a fully flat position to an upright position. The actuator assembly 12 is movable in a vertical direction by a track mechanism located below the actuator assembly 12 (not shown) and attached to a U-shaped base 39, and as schematically indicated by the arrow 80 in FIG. 1. The bellows 35 encloses a portion of the sliding track assembly. The actuator assembly 12 is also rotatable about a horizontal pivotal axis which is perpendicular to the axis of the shaft 60, and which is defined by a shaft and bearing assembly 40, located at either end of the base, which is in the form of a U-shaped bracket 39.

Figure 4:
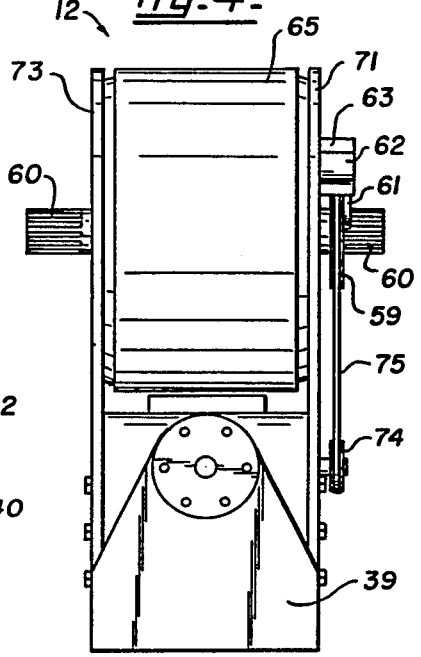
FIG. 4 is a side elevation view of the actuator assembly shown in FIG. 3.
Figure 5:
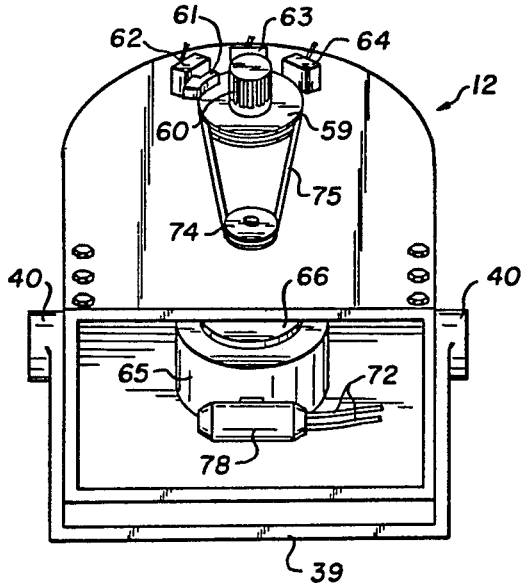
FIG. 5 is a view of the actuator assembly tilted from the position shown in FIG. 3; and, FIG. 6 is a schematic diagram of the control elements of the exercising apparatus.

Exercising member 14 consists of a shaft 36 affixed to an actuator shaft 60 splined at either end and shown in FIGS. 3 to 5. An elongated arm 34 of a rectangular cross-section, in turn, is affixed to shaft 36. A block 30, shown in FIG. 2, slidably captures arm 34 and is lockable in selectable positions thereon by a screw and wedge element 32. Integral with block 38 is a handle mount 28 which has a recess (not shown) for receiving one end of a load cell block 26 by means of a pin slidably insertable into hole 54 in mount 28, and a hole 52 in a boss 50 on one end of the load cell block 26. A boss 44 on the other hand of the load cell block 26 also has a hole 46 which aligns with a corresponding hole 48 in a handle receptacle 42 of a handle 24 to receive a locking pin (not shown). A pair of strain guages 56 and 58 each wound in a wave-length manner and oriented orthogonally to each other are mounted on a wall 57 parallel to the axis of the bosses 50 and 44 of one of two U-shaped recesses of the block 26. The load cell block 26 is positioned to provide signals proportional to force applied to the handle 24 transverse to the arm 34 and to provide signals which permit cancelling out of the torque about the axis through bosses 44 and 50 and force components parallel thereto.

Cable 38 has four wires which carry electrical signals from the load cell 26. Load cell 26 is a standard unit commercially available from a number of manufacturers.

One side of the actuator assembly 12 is shown in FIG. 3 with the cover removed. At the upper end of the assembly 12 is the actuator 65 having a shaft 60 at each end and a gear pulley 59 affixed thereto. The gear pulley 59 is, in turn, affixed to a cam 61 having a lower step 67 extending radially approximately 40 degrees and having an upper step 69 slightly further removed from the centre of the actuator arm, also subtending an angle of approximately 40 degrees from the centre of the actuator arm. Three microswitches 62, 63 and 64 are positioned around the shaft 60 and are operated by cam 61 upon rotation of the shaft 60 to predetermined angular positions. The limit switch 63 is located intermediate limit switches 62 and 64. Limit switches 62 and 64 are spaced so that they are operated by an angular sweep of the actuator of 265 degrees. Limit switch 62 is operated by contact upon clockwise rotation by the upper step 69 of the cam 61 while limit switch 64 is operated by contact with the upper step 69 upon counterclockwise rotation of the cam 61. The central limit switch 63 is operated during initial calibration in order to provide a datum point for the system which allows the determination of the angular position of the member 14.

An encoder pulley 74 is coupled to gear pulley 59 by gear belt 74. Affixed to the encoder pulley shaft is an optical shaft encoder assembly consisting of an optical shaft disk 66 and a pair of light-emitting diodes and associated photo transistor detectors (not shown). The encoder disk 66 has a plurality of inner 70 and outer 68 radially spaced apart slots through which the light-emitting diodes are directed. Relative radial spacing of the inner and outer slots is such that upon rotation of the disk, two signals are generated which are approximate square waves and are timed such that the edges of the pulses of each set of signals are 90 degrees out of phase.

The resultant signals generated allow the determination of both angular positions as well as direction and angular velocity of rotation of member 14.

The side view of the actuator assembly is illustrated in FIG. 4 which shows the actuator 63 rotatably supported by a front plate 71 and a rear plate 73. Below the actuator 65 and coupled thereto is a servo valve 78. Hydraulic lines 72 from a dump valve (not shown) located in housing 16 lead to the servo valve 78. The entire actuator assembly can be tilted as shown in FIG. 5 about base 39 in either direction to permit rotation of the arm assembly 14 about an axis inclined by a selectable amount to the horizontal.

Figure 6:
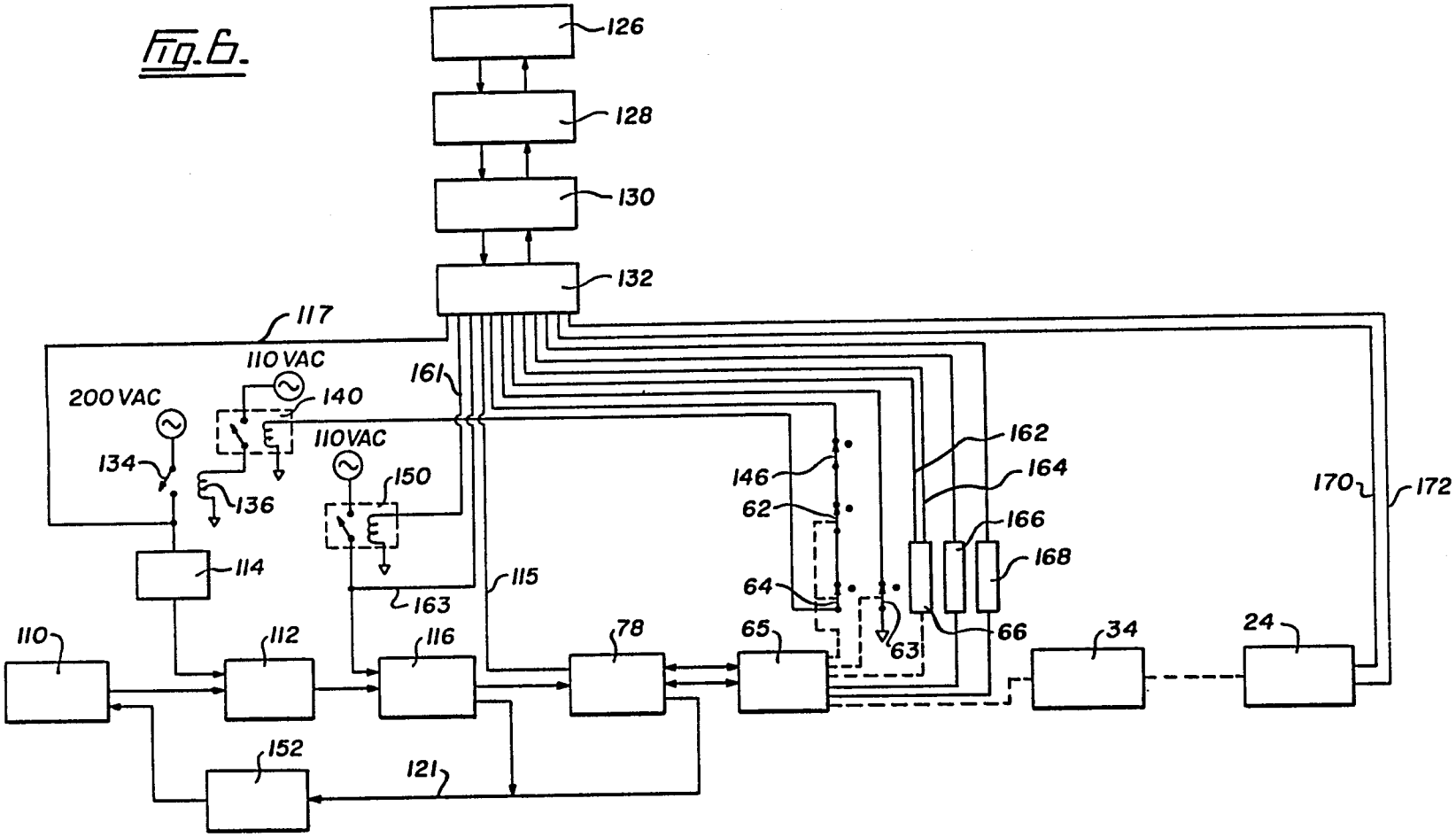

The system of control of the exercising apparatus is illustrated schematically in FIG. 6. Hydraulic fluid from a reservoir 110 is supplied to a hydraulic pump 112. The pump 112 is powered by a motor 114 and fluid which is pressurized by the pump 112 is directed into a dump valve 116. The dump valve 116 receives operating power from a 110 VAC source through relay 150. When powered, the dump valve 116 shunts pressurized fluid into a return line 121 which directs fluid through a conventional heat exchanger 152 back to the reservoir 110.

After passing the dump valve 116, pressurized fluid enters a servo valve 78 having a of outlets/inlet ports which coupled to corresponding ports of the actuator 65. Fluid flows out one of the two servo valve ports into the actuator and back into the other servo valve port. Both the direction and rate of fluid flow into the actuator 65 is controlled by electrical current directed into the servo valve 78 along cable 115. The actuator 65 is coupled mechanically to an arm 34 and handle 24 as previously discussed.

The sensing signals which are used to monitor operation of the system include voltage signals form the load cell 26 conducted along lines 170 and 172 to a signal conditioner 132. The latter voltage levels are proportional to the force supplied directly to the handle 24 and do not include any contribution due to weight of the arm 34 and block 30. A pair of pressure transducers 166 and 168 supply voltage signals to the signal conditioner 132 which are proportional to the pressure levels present across the actuator 65 which levels result from the torque applied to the actuator shaft by the user through the arm 34, block 30 and handle 24.

The shaft encoder 66 produces two set of square waves which are sent to the signal conditioner 132 along lines 162 and 164. The latter signals are indicative of actuator shaft position, angular velocity and direction of rotation.

Operation of limit switches 62 and 64 interrupt current to relay 140 causing the latter to open thereby disconnecting 110 volts AC from the coil 136 of a mechanical relay. Contacts 134 of the latter relay couple a source of 220 volts AC when closed to the motor 114. A mechanical manually operated override switch 146 is operable to cause the opening of relay 140 and thereby disconnecting the 220 volts AC source from motor 114. The latter switch can be used as a panic button by the user in the event there is a system failure.

The central limit switch 63 is operable to disconnect a line from the signal conditioner 132 from ground thereby resulting in a signal being generated which gives the microprocessor 126 a datum point for calibration purposes. With the latter datum point the microprocessor 126 can determine the angular position of the actuator shaft.

Operation of the dump valve 116 is controlled by a relay 150 which, in response to signals from the signal conditioner 132 sent along line 161, close and connect 110 volts AC to the dump valve 116. The application of power to the dump valve 116 is monitored by line 163 leading to the signal conditioner 132. Normally, the application of power 114 is sensed by line 117 leading to the signal conditioner 132. The latter two power sensing circuits both allow the microprocessor 126 to tell if its control of the motor 114 and dump valve 116 is effective or if something else is causing motor 114 and dump valve 116 not to work.

Control of the operation of the system is achieved by a microprocessor 126 which is electrically coupled to a bus interface 128 followed by a hardware interface 130 and a signal conditioner 132. The bus interface 128 decodes the address data and control data from the microprocessor 126 to generate signals for the microprocessor 126 to access various reglaters and latches of the bus and hardware interface electronics.

The bus interface 128 also conditions data from the hardware interface 130 and provides isolation of the microprocessor 126 from the latter. The hardware interface 130 holds the signals stable until updated from either the microprocessor 126 or the system hardware. It also generates signals from the load cell 26 and pressure level signals from the actuator 65 for a fixed time period before transferring that data to the microprocessor 126. Finally, the hardware interface 130 also counts pulses from the shaft encoder 66.

The function of the signal conditioner 132 is to adjust voltage levels, to buffer and boost drive signals for the relays and to filter signals. For example, signals destined for the servo valve 78 which are generated by the computer 126 and conditioned by the interfaces are pulse width modulated. The signal conditioner 132 converts the signals to a current proportional to the pulse width. The converted current is then used to drive the servo valve 78. In addition, force pressure signals in the form of voltages are converted by the signal conditioner 132 to frequency sent to the hardware interface 130. The signal conditioner 132 includes line drivers to boost the drive capability of binary signals sent to the interfaces and line receivers to wave shape binary signals sent from the interfaces. Finally, the signal conditioner 132 includes optical isolating circuits to isolate from the rest of circuitry power sensors used to detect whether or not power is being applied to the motor 114 and dump valve 116.

Operation of the exercising apparatus involves the computer under control of a software program first entering a calibrate mode on initial powering-up of the system. The computer or microprocessor 126 then forces the actuator 65 to rotate in a clockwise direction until the central limit switch 63 is closed, thereby providing a signal which gives the computer 126 a datum point so that it can locate the angular position of the member 14. The actuator shaft is then rotated approximately 25° in a counter-clockwise direction at which point the computer or microprocessor 126 checks the pressure levels in the actuator 65 to ascertain whether the hydraulic fluid is pressurized. The microprocessor 126 also causes offsets to be adjusted in order to compensate for shifts in the zero level of the circuitry, any servo valve offset and for weight in the actuator shaft in the event it is titled from a horizontal position.

The program then causes the system to enter into an idle mode in which data may be entered into the microprocessor determining the type of exercise to be engaged in addition to changes in previously entered data. The system then receives input data which may include the number of repitions, the initial angle, the final angle, the required velocity, the minimum force below which the arm 14 will stop, whether the force to be applied is concentric or eccentric or a combination of the two, and possibly the duration of the exercise. Once the parameters are entered the arm 14 moves to a selected initial angle and cycles through the exercise routine. The exercise routine may be a constant angle or isometric exercise, a constant velocity exercise, a constant force exercise or a constant power exercise.

The microprocessor unit is a standard micro computer which contains a central processing unit, a memory, a diskelle interface, a video display interface and a bus/card cage/power supply. Any one of a number of commercially available general purpose micro computers may be employed. The servo valve employed is manufactured by Koehring of Detroit, Mich., and is an electro-magnetically activated proportional valve which controls the amount of flow and the direction of the flow by the magnitude and of current through its electro-magnetic winding.

It will be obvious to those skilled in the art that variations from the above-described system are obvious such as utilizing a potentiometer in place of an optical shaft encoder or utilization of a different system of signal processing altogether. It is considered that the signal conditioning and interface electronics given the functions desired to be performed will be obvious to the ordinary skilled technician.

Other variations, modifications and departures lying within the spirit of the invention and the scope as defined by the appended claims will be obvious to those skilled in the art,

I claim:

1. A multi-mode execising apparatus comprising a central support housing, a rotary actuator mounted to said support housing and adapted to be hydraulically driven in opposite rotational directions about a rotational axis, and including an output shaft extending along said rotational axis, hydraulic pump means for pressurizing a hydraulic fluid, servo valve means interconnected between said pressurized hydraulic fluid and said rotary actuator for controlling fluid flow in each direction through said actuator in response to an electrical input signal, an arm extending radially with respect to said rotational axis and having one end thereof fixed to said output shaft, and an opposite end spaced radially from said rotational axis, a slider slideably mounted to said arm and including locking means for releaseably positioning said slider at an adjustable location along the radial length of said arm, a user engageable handle adapted to be engaged by the body of the user during use of said apparatus, block means mounting said handle to said slider and such that said handle extends in a direction generally parallel to said rotational axis, said block means including load cell means for providing an electrical signal which is proportional to the magnitude of the force exerted by the user on said handle during use of said apparatus.

position sensing means for generating an electrical signal representative of the rotational position of said actuator, and control means for controlling the input electrical signal to said servo valve means in response to the signals from said load cell means and said position sensing means and in accordance with a predetermined control program, and whereby the positioning of said load cell means immediately adjacent the user handle serves to effectively avoid any force component from the weight of said arm and said slider from being included in the output signal of said load cell means.

2. The exercising apparatus as defined in claim 1 wherein said output shaft includes opposite ends which are positioned on respective opposite sides of said rotary actuator, and further comprising means for releaseably mounting said one end of said arm to either of said opposite ends.

3. The exercising apparatus as defined in claim 2 wherein said load cell means includes means for cancelling any torque forces about an axis which is parallel to said radially extending arm.

4. The exercising apparatus as defined in claim 2 wherein said apparatus further comprises a bracket assembly mounted to said support housing, and an actuator assembly which includes said rotary actuator, with said actuator assembly being mounted to said bracket assembly for selective pivotal movement about a horizontal pivotal axis which is perpendicular to said rotational axis of said actuator.

5. The exercising apparatus as defined in claim 4 wherein said apparatus further comprises a pair of horizontal body support members mounted to said support housing, and with said pair of body support members being positioned on respective opposite sides of said pivotal axis, and such that the user may be positioned on one of said support members on either side of said actuator assembly and with said radial arm mounted to the adjacent end of said output shaft.

6. The exercising apparatus as defined in claim 1 wherein said pump means includes a hydraulic fluid reservoir, a hydraulic pump having an inlet line connected to said reservoir and an outlet line connected to said servo valve means, and dump valve means positioned in said outlet line for selectively shunting hydraulic fluid back to said reservoir.

7. The exercising apparatus as defined in claim 1 further comprising means for sensing the fluid pressure across said actuator and providing output signals to said control means which are representative of the torque applied to said actuator and so as to permit detection of abnormal applications of force to said actuator.

8. A multi-mode exercising apparatus comprising a central support housing, an actuator assembly mounted to said support housing, said actuator assembly including a rotary actuator adapted to be hydraulically driven in opposite rotational directions about a rotational axis, and including an output shaft extending along said rotational axis, and with said output shaft having opposite ends which are positioned on respective opposite sides of said rotary actuator, hydraulic pump means mounted to said support housing for pressurizing a hydraulic fluid.

servo valve means interconnected between said pressurized hydraulic fluid and said rotary actuator for controlling fluid flow in each direction through said actuator in response to an electrical input signal, a radial arm, means releasably and selectively mounting said radial arm to either one of said ends of said output shaft, and such that said radial arm extends radially with respect to said rotational axis.

a user engageable handle adapted to be engaged by the body of the user during use of said apparatus, means mounting said handle to said radial arm and such that said handle extends in a direction generally parallel to said rotational axis, load cell means for providing an electrical signal which is proportional to the magnitude of the force exerted by the user on said handle during use of said apparatus, position sensing means for generating an electrical signal representative of the rotational position of said actuator, and control means for controlling the input electrical signal to said servo valve means in response to the signals from said load cell means and said position sensing means and in accordance with a predetermined control program, whereby the user may be positioned in either side of said actuator assembly and with said radial arm mounted to the adjacent end of said output shaft.

9. The exercising apparatus as defined in claim 8 further comprising bracket means mounting said actuator assembly to said support housing for selective pivotal movement about a horizontal pivotal axis which is perpendicular to said rotational axis of said actuator.

10. The exercising apparatus as defined in claim 9 further comprising a pair of horizontal body support members mounted to said support housing, and with said pair of body support members being positioned on respective opposite sides of said actuator assembly, and such that said horizontal pivotal axis extends between said pair of body support members and the user may be positioned on one of said body support members on either side of said actuator assembly.

11. The exercising apparatus as defined in claim 10 further comprising sliding track means mounting said bracket assembly to said central support housing so as to permit selective vertical movement of said actuator assembly.

12. The exercising apparatus as defined in claim 11 wherein each of said body support members comprises a flat cushion.

* * * * *